US006738019B1

(12) United States Patent
Luz et al.

(10) Patent No.: US 6,738,019 B1
(45) Date of Patent: May 18, 2004

(54) APPARATUS AND METHOD FOR DRIVING A SECTORED ANTENNA

(75) Inventors: Yuda Luz, Buffalo Grove, IL (US); Ron Rotstein, Arlington Heights, IL (US); Jiangnan Jason Chen, Hawthorn Woods, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/411,530

(22) Filed: Apr. 10, 2003

(51) Int. Cl.[7] ..... H01Q 3/22; H01Q 3/24; H01Q 3/26

(52) U.S. Cl. ..... 342/373

(58) Field of Search ..... 342/373

(56) References Cited

U.S. PATENT DOCUMENTS 5,784,031 A * 7/1998 Weiss et al. ..... 342/373
5,854,611 A 12/1998 Gans et al. ..... 342/373
5,987,037 A 11/1999 Gans ..... 370/480
6,243,038 B1 * 6/2001 Butler et al. ..... 342/373
6,304,214 B1 * 10/2001 Aiken et al. ..... 342/362

* cited by examiner

*Primary Examiner*—Theodore M. Blum
(74) *Attorney, Agent, or Firm*—Posz & Bethards, PLC; Charles W. Bethards

(57) ABSTRACT

An apparatus for driving a sectored or multi beam antenna configuration and corresponding method of level loading amplifiers is suitable for use in a transmitter. The apparatus includes a plurality of Fourier Transform Matrix (FTM) devices 501, each FTM device having a plurality of outputs 513 and a plurality of inputs 511; where the plurality of outputs of an FTM device 503 include a first output A1 and a second output B2 arranged to be coupled, respectively to a first antenna array 403 and a second antenna array 405 and these antenna arrays are included in a plurality of antenna arrays collectively comprising the antenna configuration where the first antenna array and the second antenna array corresponding to different sectors and beams, and a plurality of amplifiers 517, 519, 521, 523 corresponding to each of the FTM devices, where one of the plurality of amplifiers coupled to and driving each of the plurality of inputs.

22 Claims, 4 Drawing Sheets

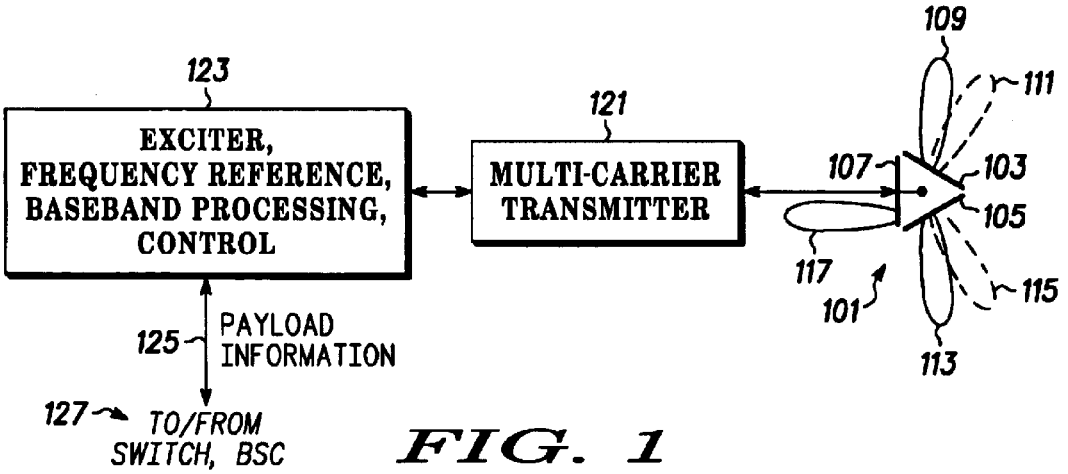
FIG. 1
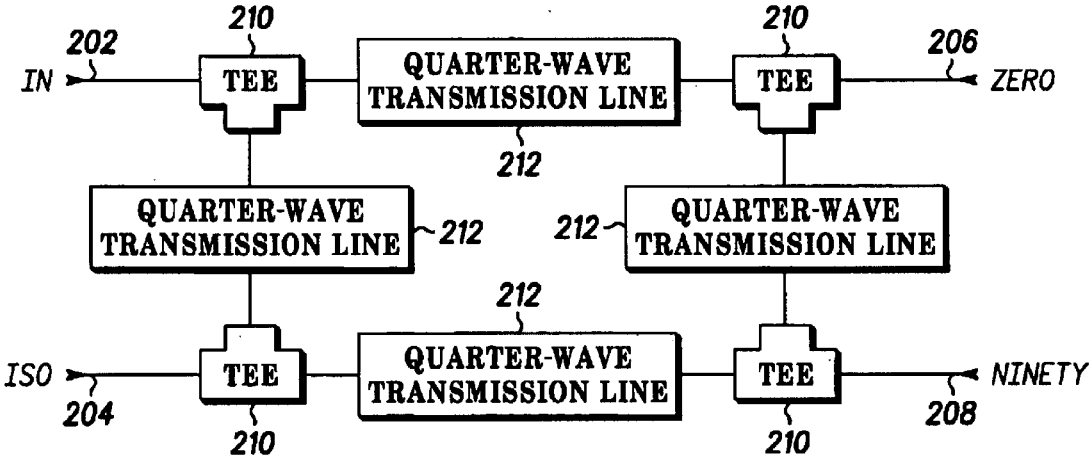
- PRIOR ART - FIG. 2 200

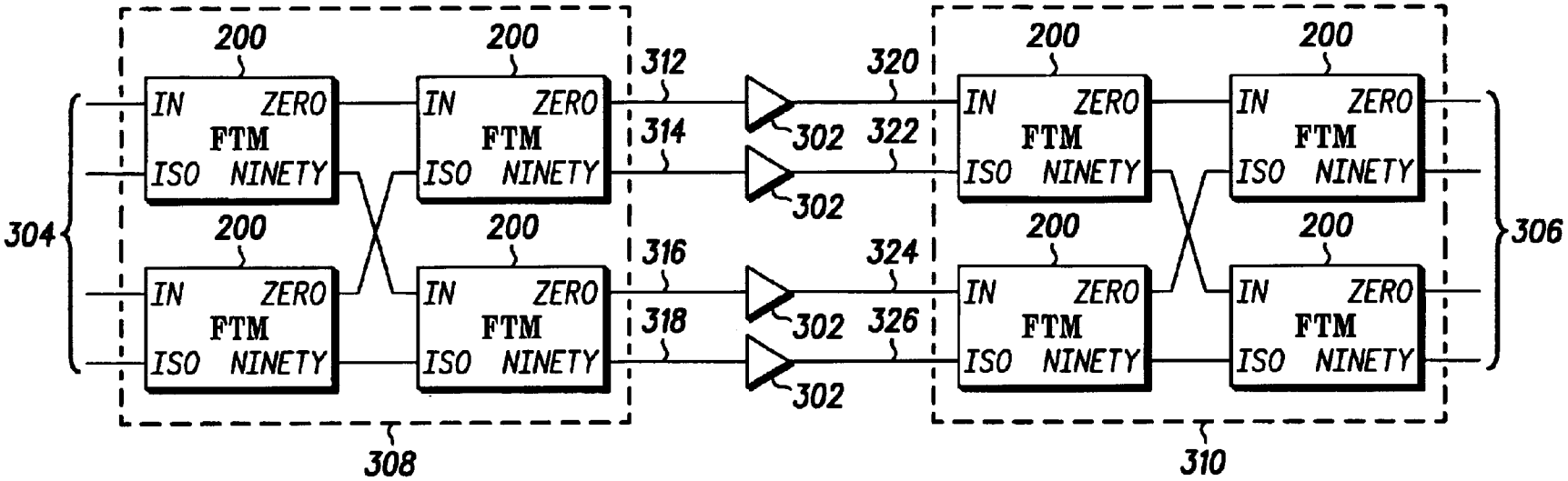
- PRIOR ART - FIG. 3
300

APPARATUS AND METHOD FOR DRIVING A SECTORED ANTENNA

FIELD OF THE INVENTION

This invention relates in general to radio frequency (RF) communication systems, and more specifically to an apparatus and method for driving a sectored, preferably beamed antenna system.

BACKGROUND OF THE INVENTION

It is known that Fourier Transform Matrix (FTM) devices can be used in a multi-carrier RF communication system, specifically transmitters therein, for amplifying a plurality of RF signals or carriers. Certain advantages can be associated with the use of FTM devices. These include one or more of a reduced peak-to-average power requirement for individual amplifiers used in conjunction with the FTM devices and an attendant improvement in efficiency of these amplifiers. In addition a degree of amplifier redundancy can be available when FTM devices are used in order to share amplifiers among multiple carriers. Furthermore the efficiency of amplifier utilization in the sense of percentage of amplifiers being used of those available can be improved with this sharing.

Unfortunately, if signals or carriers that are to be processed through any one of the FTM devices are correlated or correlated to a large extent some of these advantages, such as improvements in the peak to average ratio can not be realized. Also uneven loading of amplifiers associated with different FTM device can be a problem, particularly in sectored antenna arrangements.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages in accordance with the present invention.

FIG. 1 is depicts a simplified and representative system diagram of a multi carrier transmitter driving a sectored steerable beam antenna configuration;

FIG. 2 is one form of an electrical circuit of a prior-art 2×2 Fourier Transform Matrix (FTM) device;

FIG. 3 is an electrical block diagram of a prior-art FTM amplifier with an input and an output 4×4 FTM device;

DETAILED DESCRIPTION OF THE PREFERRED EMBODIMENTS

Figure 4:
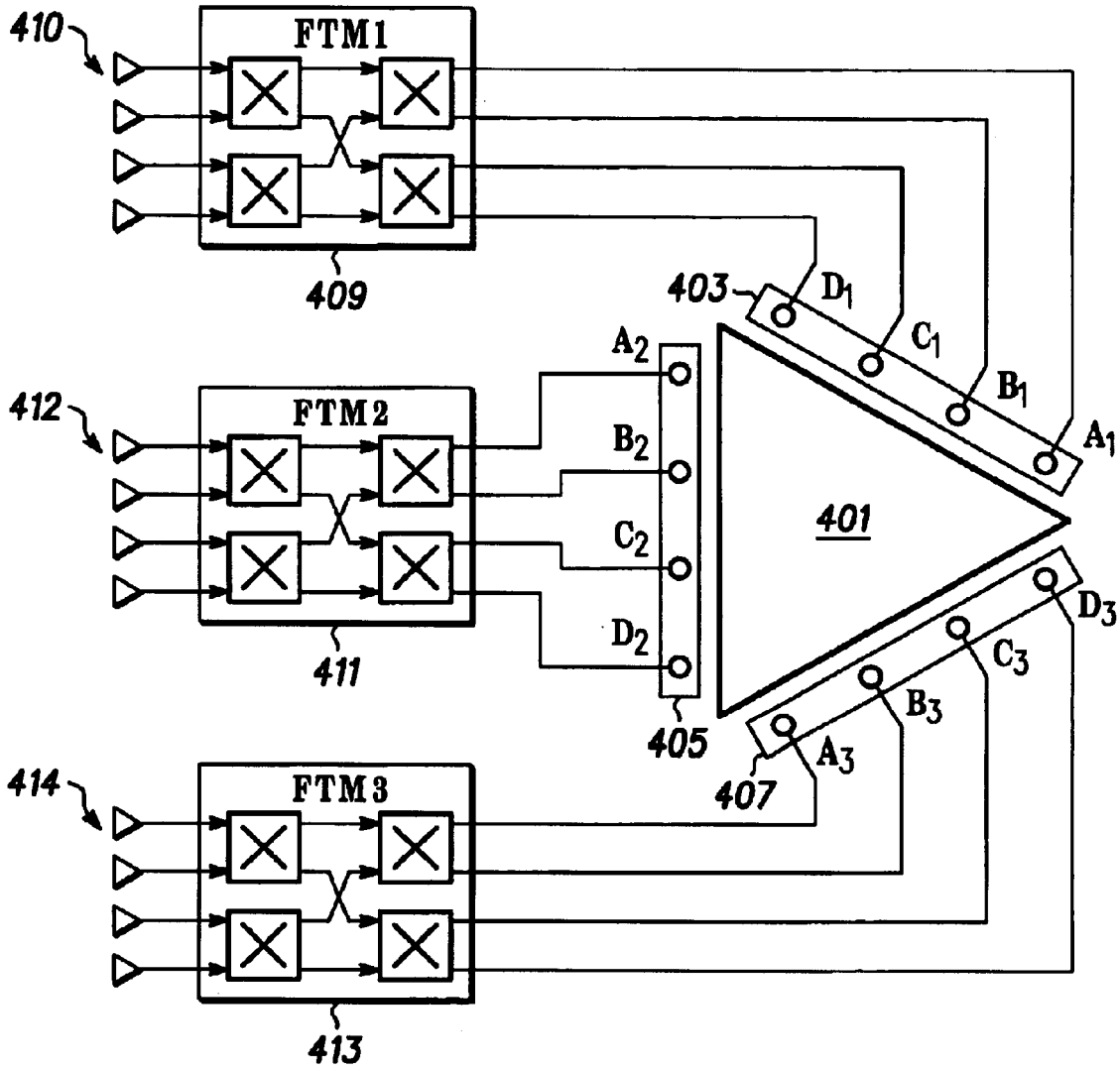
FIG. 4 is an electrical block diagram of an exemplary amplifier using a plurality of output 4×4 FTM devices suitable for demonstrating problems that can be encountered in such amplifiers when driving a sectored antenna configuration.

In overview, the present disclosure concerns radio frequency (RF) communication systems. More particularly, various inventive concepts and principles embodied as a method and apparatus for driving a sectored, preferably steerable beam, antenna configuration for use in such RF communications systems will be discussed and disclosed. The apparatus is suitable for use in a radio frequency amplifier such as can be employed in base stations and the like. The RF communications systems of particular interest are those being deployed and developed such as Integrated Dispatch Enhanced Networks from Motorola, Inc. and cellular systems and evolutions thereof that utilize multi-carrier amplifiers and sectored beam antennas for increased capacity, although the concepts and principles have application in other systems and devices.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in one or more conventional micro-strip circuits suitable for providing Fourier Transform Matrix (FTM) devices, radio frequency amplifiers, and low loss radio frequency interconnects. It is expected that one of ordinary skill, notwithstanding possibly significant effort and many design choices motivated by, for example, available time, current technology, and economic considerations, when guided by the concepts and principles disclosed herein will be readily capable of designing, providing, and otherwise generating such (FTM) devices, radio frequency amplifiers, and low loss radio frequency interconnects with minimal experimentation. Therefore, in the interest of brevity and minimization of any risk of obscuring the principles and concepts according to the present invention, further discussion of such (FTM) devices, radio frequency amplifiers, and low loss radio frequency interconnects, if any, will be limited to the essentials with respect to the principles and concepts employed by the preferred embodiments.

Referring to FIG. 1, a simplified and representative system diagram of a multi carrier transmitter 121 driving a sectored, preferably steerable, beam antenna configuration 101 will be discussed and described. FIG. 1 shows the sectored antenna arrangement or configuration 101 comprising three antenna arrays 103, 105, 107 with each array generally used to provide coverage (radiate outbound and absorb inbound radio frequency energy) for a respective 120 degree sector. As depicted the antenna configuration 101 is a beam or steerable, possibly switched, beam antenna system. Each of the antenna arrays is comprised of a plurality of antenna elements and suitable for forming beam like coverage patterns for providing relative gain to particular coverage areas within the respective sector. For example, antenna array 103 is depicted with a beam 109 and another beam 111, while antenna array 105 is providing beams 113, 115 and array 107 shows beam 117. In order for a signal to reach a wireless communications unit located in the upper portion of the sector served by antenna array 103 the beam or coverage pattern depicted as 109 would likely need to be used. These particular beams or coverage patterns are provided or realized when each of the antenna elements within the antenna array are driven by a signal or carrier at the proper power level and relative phase relationship with respect to signals driving the other elements as is generally known.

A multi carrier transmitter 121 amplifies lower level signals and is coupled to and drives the respective elements of the antenna configuration 101. The lower level signals, from a simplified perspective, are provided to the multi carrier transmitter 121 by an exciter, frequency reference, base band processing, and control function 123. The base band processing operates on payload information 125 that is provided from or if the receiver function (not shown) is considered to a base site controller, switch or the like that is not relevant or further discussed in this disclosure.

Referring to FIG. 2, one form of an electrical circuit of a prior-art 2×2 Fourier Transform Matrix (FTM) device 200 will be discussed and described. The electrical circuit of the prior-art 2×2 (FTM) 100 is a basic building block for higher input output FTM devices and includes first and second inputs 202, 204 coupled to a plurality of tees 210 and quarter-wave transmission lines 212, arranged as depicted, and having first and second outputs 206, 208. The basic 2×2 FTM 200 is also sometimes referred to as a branch line coupler. It will be appreciated that, alternatively, other forms of FTM circuits can be utilized to produce quadrature signals at the first and second outputs 206, 208. RF amplifier networks comprising FTMs are known and can exhibit advantages and problems such as discussed briefly above. For further information on the application of FTMs to RF amplifier networks, the reader is referred to "4×4 Hybrid Matrix Power Amplifier" by Jeff Merrill, published 10/98 in *Wireless Design and Development.*

Referring to FIG. 3, an electrical block diagram of a known FTM amplifier 300 with an input and an output 4×4 FTM device 308, 310 will be discussed and described. The prior art amplifier including FTM devices thereby forming an amplifier network includes the first or input 4×4 FTM 308 comprising four of the basic FTMs 200 inter coupled as shown. The input 4×4 FTM 308 includes four FTM inputs 304 for receiving four separate input signals, and further includes four FTM outputs 312–318 producing four intermediate signals. The four FTM outputs 312–318 are coupled, respectively, to four amplifiers 302, whose outputs are coupled, respectively, to four corresponding FTM inputs 320–326 of the output or second 4×4 FTM 310 comprising another four of the basic FTMs 200 inter coupled as shown to reproduce four separate and now amplified input signals at four FTM outputs 306. It is preferred that the four amplifiers 302 have substantially identical insertion phase and gain with respect to one another in order to enhance isolation of one signal from another.

In operation, the first FTM 308 produces the four intermediate signals comprising phase-shifted mixes of the four input signals at the FTM outputs 312–318, while the second FTM 310 converts four amplified phase-shifted mixes back into four separate amplified input signals at the outputs 306. The amplifiers 302 each amplify one of the four phase-shifted mixes of the four input signals. If one of the amplifiers 302 fails, the four separate amplified input signals will still appear at the FTM outputs 306, but at a lower power level and possibly reduced isolation between the four signals. If only one of the inputs 304 has a signal at any one time, all of the amplifiers 302 will be amplifying a phase shifted version of that one signal and the output FTM 310 will combine or recombine the signals at the outputs from all of the amplifiers to provide an amplified signal at one the outputs 306. Note that so long as the input signals are not correlated it is unlikely that all of the amplifiers will need to produce a peak signal at the same time.

Referring to FIG. 4, an electrical block diagram of an amplifier system using a plurality of output 4×4 FTM devices for driving a sectored antenna configuration will be discussed and described. The apparatus or amplifier arrangement shown in FIG. 4 is suitable for demonstrating and discussing problems that can be encountered in such amplifier systems. The sectored antenna system or configuration 401 shown in FIG. 4 comprises antenna arrays 403, 405, 407. Each of the antenna arrays includes a plurality of antenna elements, specifically four elements, with antenna array 403 including antenna elements A1, B1, C1, D1, antenna array 405 including antenna elements A2, B2, C2, D2, and antenna array 407 including antenna elements A3, B3, C3, D3.

This antenna arrangement is especially suited to a steered bean or switched beam antenna configurations. As is known by driving the respective elements of one of the arrays with a signal and controlling the power level and relative phase relationship between the signals as coupled to the respective elements the pattern of the signal radiated by the antenna array can be controlled. In steerable beams this pattern is more or less continuously controlled over the 120 degrees associated with a given array. In switched beam antenna arrangements a finite set of power levels and phase related signals are available, coupled to and used to drive the antenna elements. Thus, a corresponding finite set of patterns or beams are available from or provided by the antenna.

As depicted and as typically connected, each of the antenna arrays 403, 405, 407 is driven by one FTM device, specifically and respectively FTM device 409, 411, 413. Amplifiers, 410, 412, 414, each of which is an array of four amplifiers, respectively drive the FTM devices 409, 411, 413. More specifically FTM device 409 has a first through fourth output coupled respectively to antenna elements A1, B1, C1, D1 of antenna array 403. FTM device 411 has a first through fourth output coupled respectively to antenna elements A2, B2, C2, D2 of antenna array 405. FTM device 413 has a first through fourth output coupled respectively to antenna elements A3, B3, C3, D3 of antenna array 407.

This connection arrangement between transmitters using FTM devices and antenna arrays or elements is typical, straight forward, and facilitates connections throughout the base station. For example the individual signals for each element in an array likely require various common base band processing and specific phase relationships between the signals for the elements all of which are facilitated by the arrangement of FIG. 4. However the arrangement of FIG. 4 wherein one FTM device is coupled to all of the elements in an antenna array creates problems. For example the signals for the respective elements in any one antenna array are likely to be highly correlated. Thus when all or most of the elements for any one antenna array are driven from one FTM device the peak to average ratio for the amplifiers that drive that FTM device will suffer. Additionally power levels from one antenna array to another may vary and power levels between antenna elements will almost always vary in order to enhance beam shapes and directivity.

Figure 5:
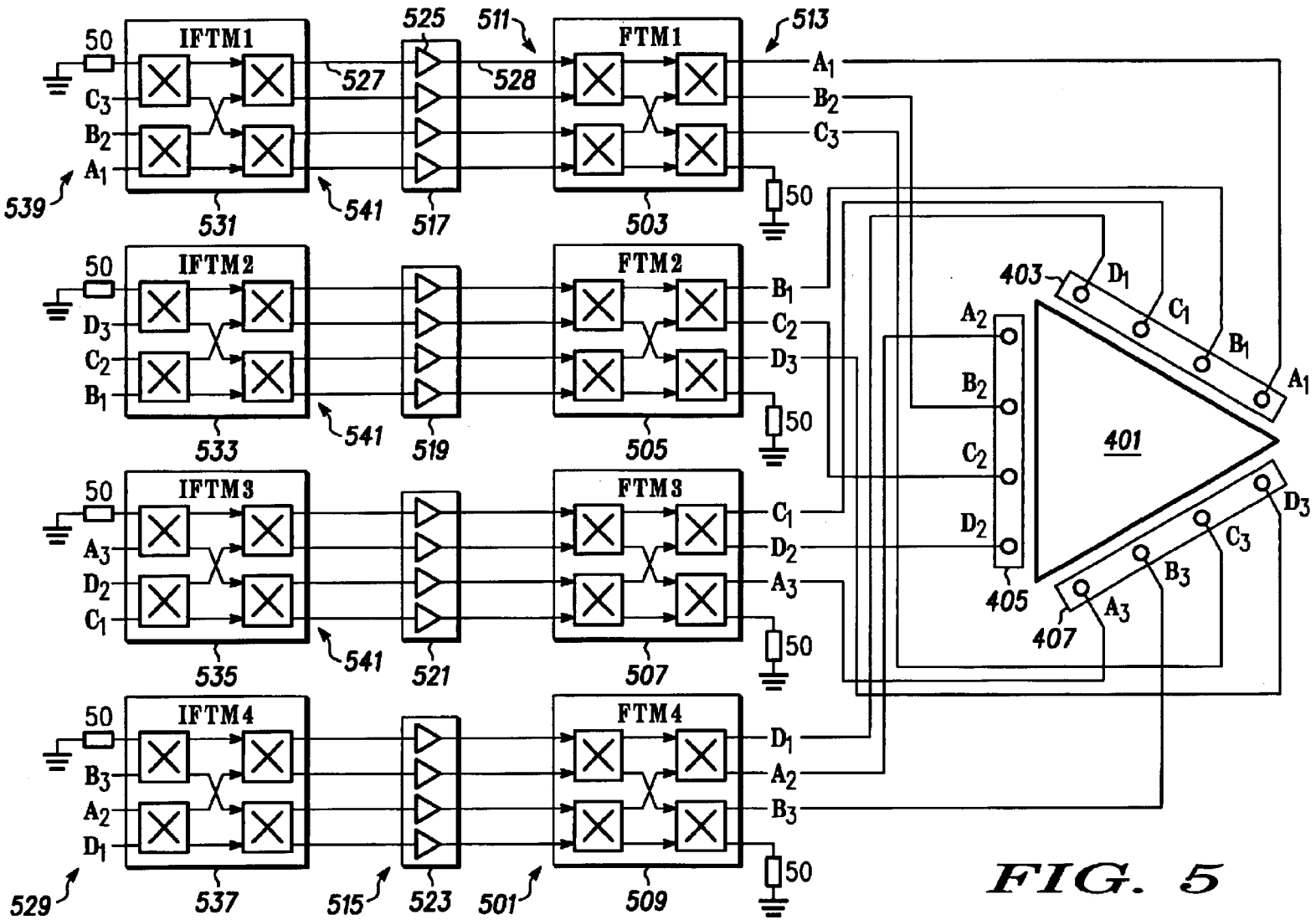
FIG. 5 is an electrical block diagram of an apparatus and amplifier for driving a sectored antenna configuration in accordance with the present invention.

Referring to FIG. 5, an electrical block diagram of an apparatus and amplifier for driving a sectored, preferably multi beam, antenna configuration will be discussed and described. The antenna configuration 401 with antenna arrays 403, 405, 407 each with four antenna elements from FIG. 4 is depicted. Note also that the architecture depicted in FIG. 5 includes 4 of the transmitters with input and output 4×4 FTM devices that were described above with reference to FIG. 3. Antenna arrays and sectored antenna systems are well known. The book, *Phased Array Antenna Handbook,* authored by Robert J Mailloux, Artech House 1993 is a reference that may be helpful. Similarly FTM devices are known and reviewed extensively in the above noted reference. These may be constructed from couplers and other items, such as splitters available from, for example, Anaren Microwave. Furthermore the radio frequency amplifiers or power amplifiers are known and widely available from manufacturers such as Motorola. In one embodiment, FIG. 5 shows an apparatus for driving a multi beam antenna configuration. The apparatus comprises a plurality of Fourier Transform Matrix (FTM) devices 501, each of the FTM devices 503, 505, 507, 509, such as FTM device 503, having a plurality of outputs 513 and a plurality of inputs 511. The plurality of outputs of each of the plurality of FTM devices includes one or more first outputs and one or more second outputs arranged to be coupled, respectively to different antenna arrays, such as a first, second, third, and so on antenna array, these antenna arrays included in a plurality of antenna arrays that collectively comprises the multi beam antenna configuration. In this manner a signal at each of the M outputs can be arranged such that it is not correlated with a signal at any other of the M outputs for any one of the FTM devices, thus facilitating the level loading of the radio frequency amplifiers.

Each of the first, second, third, and so on antenna arrays correspond to one or more unique beams or coverage patterns. Further included is a plurality of amplifiers 515, specifically the plurality of amplifiers 517, 519, 521, 523, each comprising four amplifiers, corresponding, respectively, to the FTM devices 503, 505, 507, 509. Each of the plurality of amplifiers, such as amplifier 525 has an output 528 that is coupled to and driving one input of the plurality of inputs 511.

At least a portion of the plurality of outputs from any one FTM device, such as output A1 and output B2 are arranged to be coupled, respectively, to different antenna elements or different antenna arrays, such as antenna element A1 of the first antenna array 403 and antenna element B2 of the second antenna array 405. Note that the antenna elements are disposed, respectively, at different positions, namely A1 within the first antenna array 403 and B2 the second antenna array 405. The first element A1 and the second element B2, by virtue of the different positions within the first antenna array and the second antenna array will normally be driven at different expected power levels and with different signals having low or near zero correlation. The different expected power levels results from a concept known as tapering wherein as known the power levels at the corners or edges of an array are driven at lower nominal power levels. For example there may be a 4.5 to 5 dB difference in expected power levels.

The inventive concepts and principles discussed and described above can be utilized to provide a transmitter for driving the sectored, preferably multi beam, antenna configuration 401. The transmitter further comprises a plurality of input Fourier Transform Matrix (FTM) devices 529, each of the input FTM devices 531, 533, 535, 537 having a plurality, specifically four in FIG. 5, of inputs 539 and a plurality, specifically four, of outputs 541 as specifically indicated for FTM device 531. The plurality of radio frequency amplifiers 515, each has an input and an output. The input of one of the plurality of radio frequency amplifiers is coupled to each of the plurality of outputs of the plurality of input FTM devices. For example the input 527 of the amplifier 525 is coupled to an output of the input FTM device 531 and the output 528 is coupled to one of the plurality of input 511 of output FTM device 503. Also included in the transmitter is the plurality of output FTM devices 501 inter coupled with the antenna arrays and antenna elements as discussed above and further depicted in one embodiment by FIG. 5.

As noted above at least two of the plurality of outputs from an output FTM device, for example a first output and a second output are arranged to be coupled, respectively, to an element of one antenna array and an element of another antenna array, preferably, such that the first element and the second element are disposed at different positions within there, respective, antenna arrays. By virtue of these different positions these two antenna elements are likely to be driven by different expected power levels and by virtue of being coupled to different antenna arrays the signals driving the respective elements will have little or no or near zero correlation so long as the signals for the different arrays have little or no correlation. For example by coupling one of the outputs to an antenna element near the center of the antenna array, such as the B or C position and another output to one of the end positions A or D these elements can be driven at different expected power level. In this fashion a signal at each of the outputs will not be correlated with a signal at any other of the M outputs for any one of the FTM devices, thereby facilitating level loading of the radio frequency amplifiers.

It is also noted that the plurality of outputs, specifically active outputs, of any one of the output FTM devices corresponds to and can be equal to the plurality of antenna arrays. For example as shown 3 active outputs equal three antenna arrays. Furthermore in one embodiment each of the plurality of antenna arrays includes a plurality of antenna elements that corresponds to and can be equal to the plurality of output FM devices. For example, in FIG. 5 there are four output FTM devices depicted and this is equal to the number of antenna elements in any one of the antenna arrays.

In addition it is preferred that the plurality of second outputs of each of the plurality of output FTM devices are arranged to be or are coupled to the antenna elements such that a total expected power output for a first output FTM device does not vary more than 2 dB from a second output FTM device. In FIG. 5 for example, the B and C antenna elements may be driven with approximately 20 watts each whereas the A and D elements may be driven with approximately 10 watts each. By observation it is noted that for each output FTM device no more than two of the three active outputs are coupled to B and C elements and no more than two of the 3 outputs are coupled to A and D elements. Thus the power from the output FTM devices, noting that the signals at the respective outputs are not correlated, is the algebraic sum of the power expected from each output. Hence output FTM devices 503 and 505 would be expected to supply approximately 50 watts and output FTM devices 507, 509 would be expect to supply approximately 40 watts. The reader will note that 50 versus 40 watts is less than 1 dB difference between the expected power level between output FTM devices and thus the power levels that will need to be supplied by the amplifiers driving the respective output FTM devices.

A general algorithm that may be used to describe the connections or couplings between M outputs of N output FTM devices and N antenna elements of M antenna arrays, such as depicted in the FIG. 5 embodiment as well as other embodiments is as follows. The $m^{th}$ output of the $n^{th}$ output FTM device is arranged to be coupled to the $(n+m)^{th}$, modulo M, antenna element of the mth antenna array, for m from 0 to M−1 and n from 0 to N−1. The transmitter in FIG. 5 has each of 3 outputs of each of 4 output FTM devices arranged to be coupled to one of 4 antenna elements in each of 3 antenna arrays, with a remaining output of each of the 4 FTM devices coupled to a load. To utilize the algorithm above the M (M=3 in FIG. 5) outputs are viewed as output 0, output 1, and output 2 with output 0 designated A1, output 1 designated B2, and output 2 designated C3. Similarly the M=3 antenna arrays are array 0 403, array 1 405, and array 2 407. The N (N=4 antenna elements in FIG. 5) antenna elements are similarly designated element 0 through element 3 corresponding to element A through element D in FIG. 5. Similarly the N FTM devices are FTM device 0 503 through FTM device 3 509. It is left to the reader to inspect the various connections from each of the outputs of the output FTM devices. Please note that the signal intended to any one of the antenna elements, such as A1 can be located on the corresponding output A1 of the appropriate output FTM device as well as the corresponding input A1 of the input FTM device. Note also that one of the inputs is coupled to a load and this input corresponds to the output that is coupled to the load or specifically 50 ohm load.

FIG. 5 can also be described as an apparatus for driving a sectored antenna configuration 401. This apparatus is a transmitter or at least the output portion of a transmitter and includes N Fourier Transform Matrix (FTM) devices 501, each FTM device having M outputs 513 and a plurality of inputs 511. Each of the M outputs of each of the N FTM devices is arranged to be or is coupled to one of N antenna elements in each of M antenna arrays. The M antenna arrays collectively comprise the sectored antenna configuration with each of the M antenna arrays corresponding to a sector. In FIG. 5, N equals four as in four FTM devices with M=3 outputs and 4 antenna elements for each of 3 antenna arrays. Further included is a plurality of amplifiers 517, 519, 521, 523, one plurality for each of the FTM devices, where one of the plurality of amplifiers is coupled to and driving each of the plurality of inputs.

The M outputs of any one of the N FTM devices are arranged to be coupled to antenna elements where a first of the antenna elements is expected to be driven with a different average power level than a second of the antenna elements, as described above. Preferably the M outputs of each of the N FTM devices are arranged to be coupled to the antenna elements such that a total expected power for a first FTM device does not vary more than 2 dB from a second FTM device. The algorithm noted above can be used to specify which antenna element a particular output should be coupled to. In this manner a signal at each of the outputs can be selected or chosen such that it is not correlated with a signal at any other of the outputs for any one of the FTM devices, thus facilitating the level loading of the radio frequency amplifiers that are driving that FTM device.

From the above description one embodiment is a method for facilitating level loading of radio frequency amplifiers driving a sectored antenna configuration. The method comprises providing N Fourier Transform Matrix (FTM) devices, each FTM device having M outputs and a plurality of inputs for coupling to the radio frequency amplifiers; and arranging for each of the M outputs of each of the N FTM devices to be coupled to one of N antenna elements in each of M antenna arrays, the M antenna arrays collectively comprising the sectored antenna configuration with each of the M antenna arrays corresponding to a sector. It is expected that different sectors are used to radiate different signals and that these signals have low or no cross correlation. Thus the amplifiers will tend to be more nearly level loaded than in typical configurations where correlated signal are provided from a single FTM device.

The arranging for the each of the M outputs of the each of the N FTM devices to be coupled to the one of N antenna elements in the each of M antenna arrays further, preferably, comprises arranging for the M outputs of any one of the N FTM devices to be coupled to antenna elements where a first of the antenna elements is expected to be driven with a different average power level than a second of the antenna elements. This can include, as described above, arranging for the M outputs of each of the N FTM devices to be coupled to antenna elements such that a total expected power for a first FTM device does not vary more than 2 dB from a second FTM device. The algorithm may be used for the arranging of the outputs to be coupled to the antenna elements and as noted above and depicted in FIG. 5 one embodiment includes arranging for each of 3 outputs of each of 4 FTM devices to be coupled to one of 4 antenna elements in each of 3 antenna arrays, with a remaining output of each of the 4 FTM devices coupled to a load.

Thus, it should be clear from the preceding disclosure that the present invention provides a method and apparatus for driving a sectored and preferably beam forming antenna configuration in a radio frequency amplifier for a communications system. The method and apparatus advantageously level loads radio frequency amplifiers and maintains the desired peak to average enhancement potentials associated with FTM procedures and devices, even when signals at antenna elements in a given antenna array are correlated and operating at different power levels while still providing fault tolerance and reasonably high amplifier usage efficiencies.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A method for facilitating level loading of radio frequency amplifiers driving a sectored antenna configuration, the method comprising:

providing N Fourier Transform Matrix (FTM) devices, each FTM device having M outputs and a plurality of inputs for coupling to the radio frequency amplifiers; and arranging for each of the M outputs of each of the N FTM devices to be coupled to one of N antenna elements in each of M antenna arrays, the M antenna arrays collectively comprising the sectored antenna configuration with each of the M antenna arrays corresponding to a sector;

wherein a signal at each of the M outputs is not correlated with a signal at any other of the M outputs for any one of the FTM devices, thus facilitating the level loading of the radio frequency amplifiers.

2. The method of claim 1 wherein the arranging for the each of the M outputs of the each of the N FTM devices to be coupled to the one of N antenna elements in the each of M antenna arrays further comprises arranging for the M outputs of any one of the N FTM devices to be coupled to antenna elements where a first of the antenna elements is expected to be driven with a different average power level than a second of the antenna elements.

3. The method of claim 2 wherein the arranging for the each of the M outputs of the each of the N FTM devices to be coupled to the one of N antenna elements in the each of M antenna arrays further comprises arranging for the M outputs of each of the N FTM devices to be coupled to antenna elements such that a total expected power for a first FTM device does not vary more than 2 dB from a second FTM device.

4. The method of claim 1 wherein the arranging for the each of the M outputs of the each of the N FTM devices to be coupled to the one of N antenna elements in the each of M antenna arrays further comprises arranging for an $m^{th}$ output of an $n^{th}$ FTM to be coupled to an $(n+m)^{th}$, modulo M, antenna element of an mth antenna array, for m from 0 to M−1 and n from 0 to N−1.

5. The method of claim 4 wherein the arranging for the each of the M outputs of the each of the N FTM devices to be coupled to the one of N antenna elements in the each of M antenna arrays further comprises arranging for each of 3 outputs of each of 4 FTM devices to be coupled to one of 4 antenna elements in each of 3 antenna arrays, with a remaining output of each of the 4 FTM devices coupled to a load.

6. An apparatus for driving a sectored antenna configuration, the apparatus comprising:

N Fourier Transform Matrix (FTM) devices, each FTM device having M outputs and a plurality of inputs; each of the M outputs of each of the N FTM devices arranged to be coupled to one of N antenna elements in each of M antenna arrays, the M antenna arrays collectively comprising the sectored antenna configuration with each of the M antenna arrays corresponding to a sector; and a plurality of amplifiers for each of the FTM devices, one of the plurality of amplifiers coupled to and driving each of the plurality of inputs;

wherein a signal at each of the M outputs is not correlated with a signal at any other of the M outputs for any one of the FTM devices, thus facilitating level loading of the plurality of amplifiers.

7. The apparatus of claim 6 wherein the M outputs of any one of the N FTM devices is arranged to be coupled to antenna elements where a first of the antenna elements is expected to be driven with a different average power level than a second of the antenna elements.

8. The apparatus of claim 7 wherein the M outputs of each of the N FTM devices are arranged to be coupled to the antenna elements such that a total expected power for a first FTM device does not vary more than 2 dB from a second FTM device.

9. The apparatus of claim 6 wherein an $m^{th}$ output of an $n^{th}$ FTM is arranged to be coupled to an $(n+m)^{th}$, modulo M, antenna element of an mth antenna array, for m from 0 to M−1 and n from 0 to N−1.

10. The apparatus of claim 9 wherein each of 3 outputs of each of 4 FTM devices are arranged to be coupled to one of 4 antenna elements in each of 3 antenna arrays, with a remaining output of each of the 4 FTM devices coupled to a load.

11. An apparatus for driving a multi beam antenna configuration, the apparatus comprising:

a plurality of Fourier Transform Matrix (FTM) devices, each FTM device having a plurality of outputs and a plurality of inputs; the plurality of outputs of each of the plurality of FTM devices including a first output and a second output arranged to be coupled, respectively to a first antenna array and a second antenna array, the first antenna array and the second antenna array included in a plurality of antenna arrays collectively comprising the multi beam antenna configuration with the first antenna array and the second antenna array corresponding to a first beam and a second beam; and a plurality of amplifiers corresponding to each of the FTM devices, one of the plurality of amplifiers coupled to and driving each of the plurality of inputs wherein a signal at each of the plurality of outputs is not correlated with a signal at any other of the plurality of outputs for any one of the FTM devices, thus facilitating level loading of the plurality of amplifiers.

12. The apparatus of claim 11 wherein the first output and the second output are arranged to be coupled, respectively, to a first element of the first antenna array and a second element of the second antenna array, the first element and the second element disposed, respectively, at different positions within the first antenna array and the second antenna array.

13. The apparatus of claim 12 wherein the first element and the second element, by virtue of the different positions within the first antenna array and the second antenna array will be driven at different expected power levels and with different signals having near zero correlation.

14. A transmitter for driving a multi beam antenna configuration, the transmitter comprising:

a plurality of input Fourier Transform Matrix (FTM) devices, each with a plurality of first inputs and a plurality of first outputs;

a plurality of radio frequency amplifiers, each with an input and an output with the input of one of the plurality of radio frequency amplifiers coupled to each of the plurality of first outputs of the plurality of input FTM devices; and a plurality of output FTM devices, each output FTM device having a plurality of second inputs and a plurality of second outputs, each of the plurality of second inputs coupled to the output of a radio frequency amplifier, the plurality of second outputs of each of the plurality of output FTM devices including a first output and a second output arranged to be coupled, respectively to a first antenna array and a second antenna array, the first antenna array and the second antenna array included in a plurality of antenna arrays collectively comprising the multi beam antenna configuration with the first antenna array and the second antenna array corresponding to a first beam and a second beam;

wherein a signal at each of the plurality of second outputs is not correlated with a signal at any other of the plurality of second outputs for any one of the output FTM devices, thus facilitating level loading of the plurality of radio frequency amplifiers.

15. The transmitter of claim 14 wherein the first output and the second output are arranged to be coupled, respectively, to a first element of the first antenna array and a second element of the second antenna array, the first element and the second element disposed, respectively, at different positions within the first antenna array and the second antenna array.

16. The transmitter of claim 15 wherein the first element and the second element, by virtue of the different positions within the first antenna array and the second antenna array will be driven at different expected power levels and with different signals having near zero correlation.

17. The transmitter of claim 14 wherein the plurality of second outputs of each of the output FTM devices corresponds to the plurality of antenna arrays.

18. The transmitter of claim 17 wherein the plurality of second outputs of any one of the plurality of output FTM devices is arranged to be coupled to antenna elements where a first of the antenna elements is expected to be driven with a different average power level than a second of the antenna elements.

19. The transmitter of claim 17 wherein each of the plurality of antenna arrays includes a plurality of antenna elements that corresponds to the plurality of output FTM devices.

20. The transmitter of claim 19 wherein the plurality of second outputs of each of the plurality of output FTM devices are arranged to be coupled to the antenna elements such that a total expected power output for a first output FTM device does not vary more than 2 dB from a second output FTM device.

21. The transmitter of claim 19 wherein an $m^{th}$ second output of an $n^{th}$ output FTM device is arranged to be coupled to an $(n+m)^{th}$, modulo M, antenna element of an mth antenna array, for m from 0 to M−1 and n from 0 to N−1.

22. The transmitter of claim 14 wherein each of 3 second outputs of each of 4 output FTM devices are arranged to be coupled to one of 4 antenna elements in each of 3 antenna arrays, with a remaining output of each of the 4 FTM devices coupled to a load.

* * * * *